US005720435A

United States Patent [19]

Hunter

[11] Patent Number: 5,720,435

[45] Date of Patent: Feb. 24, 1998

[54] ROTARY SPRINKLER WITH INTERMITTENT GEAR DRIVE

[75] Inventor: Richard E. Hunter, La Jolla, Calif.

[73] Assignee: Hunter Industries, Inc., San Marcos, Calif.

[21] Appl. No.: 617,371

[22] Filed: Mar. 18, 1996

[51] Int. Cl.[6] ..... B05B 3/04

[52] U.S. Cl. ..... 239/204; 239/240

[58] Field of Search ..... 234/DIG. 1, 240–242, 234/201–206

[56] References Cited

U.S. PATENT DOCUMENTS

| | | | |
|---|---|---|---|
| 3,035,778 | 5/1962 | Kinbro et al. | 239/242 X |
| 3,623,667 | 11/1971 | Costa | 239/240 X |
| 3,934,820 | 1/1976 | Phaup | 239/205 |
| 4,501,391 | 2/1985 | Hunter | 239/240 X |
| 5,330,103 | 7/1994 | Eckstein | 239/240 X |

*Primary Examiner*—Kevin Weldon

*Attorney, Agent, or Firm*—Baker, Maxham, Jester & Meador

[57] ABSTRACT

A sprinkler unit comprises a housing having an inlet for connecting to a source of water, a rotating head mounted in an upper end of the housing and including an outlet nozzle for distributing a stream of water outward from the housing, a drive assembly including a turbine and a reduction gear drive train connecting the turbine to the head for rotating the head, the drive train having a gap for intermittently interrupting the drive for causing the head to intermittently pause during rotation thereof.

20 Claims, 2 Drawing Sheets

ROTARY SPRINKLER WITH INTERMITTENT GEAR DRIVE

BACKGROUND OF THE INVENTION

The present invention relates to irrigation sprinklers and pertains particularly to an improved gear driven sprinkler unit.

The artificial distribution of water through irrigation systems is in wide use throughout the world today. One of the most widely used systems, particularly for lawn areas and playing or athletic fields, is the sprinkler system wherein a plurality of sprinkler units are positioned about a land area for distributing water over the surface of the land area.

One of the most popular sprinkler units currently used is a gear driven rotary head that rotates about a generally vertical axis and covers either an arc segment or a full circle. Such units employ a water driven turbine connected through a reduction drive gear train to the sprinkler head in which a nozzle is mounted to direct a stream of water outward in a circle about the rotary axis of the sprinkler unit. Some sprinkler units rotate in a continuous full circle while others are provided with reversing mechanism so that it covers an adjustable arc about its rotary axis.

It has been observed that a stream of water from a rotating sprinkler unit appears to reach farther when it stops from its motion. Careful observation and measurement has confirmed that in fact the stream does extend farther. Since maximum distance or reach is a desirable characteristic, it is desirable to have means to achieve maximum reach of a rotary sprinkler unit.

Accordingly, it is desirable that a rotating sprinkler unit be available having means for periodic interruption of its rotation to enable it to achieve its maximum reach during operation.

SUMMARY AND OBJECTS OF THE INVENTION

Accordingly, it is a primary object of the present invention to provide a sprinkler unit having an intermittent interruption in its drive so that it will provide maximum reach.

In accordance with the primary aspect of the present invention, a rotary driven sprinkler unit is provided with means for intermittent interruption of the drive in order to extend the reach of the unit.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
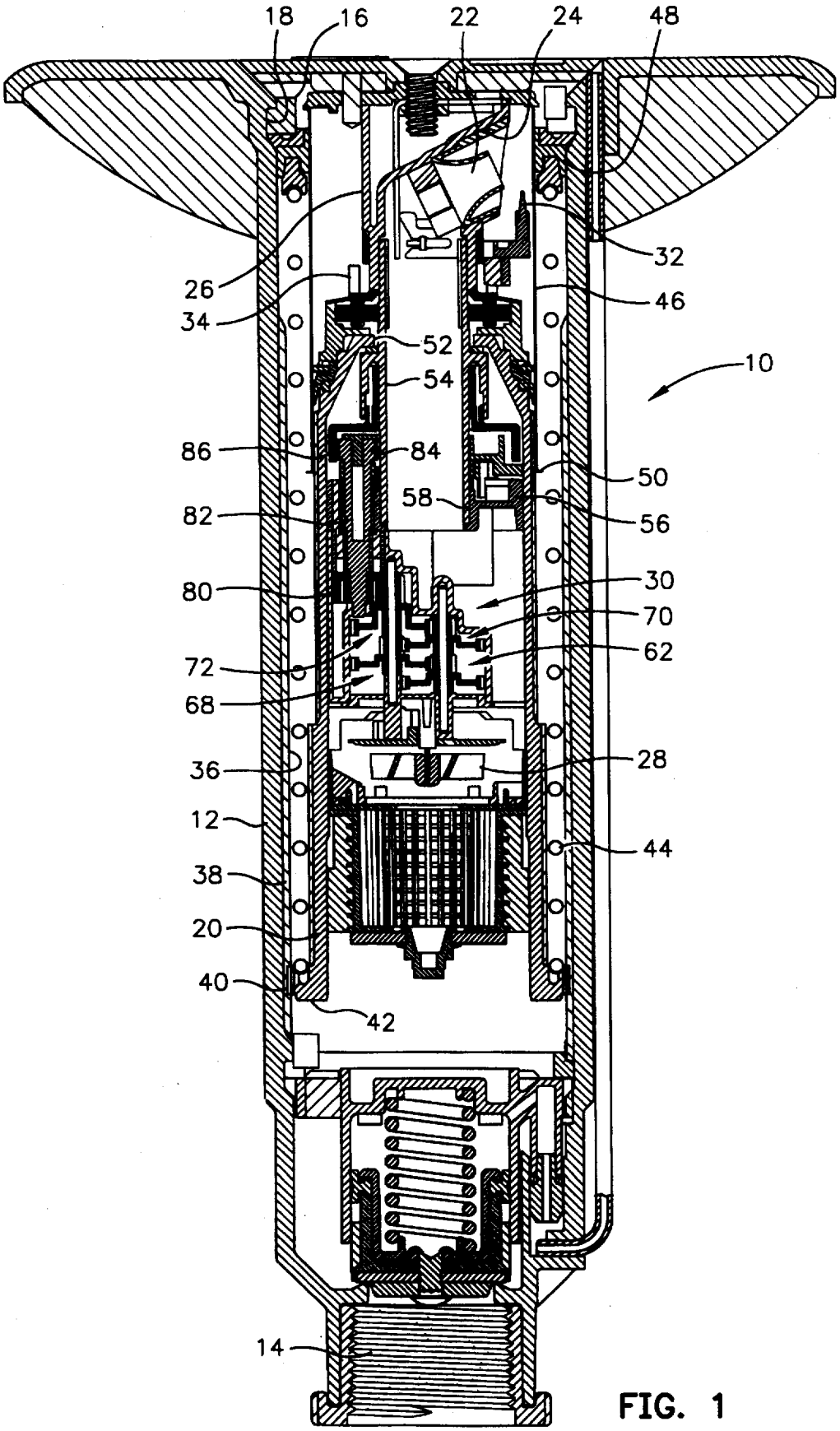
FIG. 1 is a side elevation view of a sprinkler unit embodying a preferred embodiment of the invention showing the nozzle positioned for insertion.

Referring to the drawings, particularly to FIG. 1, there is illustrated a side elevation view in section of a sprinkler unit embodying the present invention. This sprinkler unit is of the type represented and disclosed for example in U.S. Pat.

No. 4,568,024, entitled "Oscillating Sprinkler", granted Feb. 4, 1986 to the assignee of the subject application, said patent being incorporated herein by reference as though fully set forth. The sprinkler unit is turbine driven through a reduction drive gear train that may be reversible and have an adjustable arc. Certain units may be made full circle with or without a reversing drive. Other sprinkler units are variable arc from about forty degrees up to about three-hundred sixty degrees.

The sprinkler unit, designated generally by the numeral 10, comprises a generally cylindrical tubular outer housing 12, having an inlet opening or end 14 threaded for mounting to the end of a riser or the like for a source of pressurized water. An outlet end, which is normally disposed and oriented to be the top of the unit, is provided with a suitable retaining ring 16 detachably mounted therein by means of an annular recess 18 for retaining a retractably mounted inner housing or riser 20 in a suitable manner.

An inner tubular housing 20 is retractably mounted in the outer housing 12 for extension upward therefrom and includes a nozzle 22 mounted in an upper or outer end thereof. The nozzle is mounted in a passage or socket 24 in a rotatable head 26 and rotatably driven by means of turbine 28 through a reduction gear drive gear train designated generally at 30, as more fully described herein below. The particular unit illustrated is designed to continuously rotate about a central axis of the housing. A stream interrupting pin 32 is intermittently extended into the stream of water by an series of annular disposed cams 34 to break up and improve the distribution of the stream of water closer in to the unit.

The inner housing 20 is retractably mounted within a bore 36 of the outer housing 12, and is oriented by internal ribs 38 and by means of teeth 40 on radial flange 42 at the lower end thereof. An elongated coil compression spring 44 engages shoulder or flange 42 at the lower end of inner housing 20, and is confined within the bore by means of ring 16 at the upper end. The spring 44 is compressed for biasing the inner housing or riser 20 to the lowermost or retracted position, as illustrated. The terms inner housing and riser are used interchangeably herein.

A grit or dirt resistant tubular sleeve 46 is reciprocally mounted on and floats on a seal assembly 48 within a space between the inner housing 20 and the outer housing 12 in the illustrated embodiment. The sleeve 46 moves or is carried with and is considered a part of the inner housing 20 to protectively cover the nozzle during movement of the inner housing between extended and retracted positions. In the absence of the sleeve 46, the seal 48 will act directly on the outer surface of the retractable housing 20. The sleeve is formed to have "grit resistant surfaces", which as used herein, means a surface having a hardness and finish, such that it will resist scratches, abrasion and embedding of fine grit or dirt particles into the surface at operating forces and pressures. This could include certain plastics, such as acetal plastics, commonly sold under the trademark Delrin. This sleeve, however, is preferably constructed of a sheet metal such as stainless steel having a hard grit resistant outer surface to enable it to move through a layer of soil without grit from the soil becoming embedded therein.

The sleeve is preferably on the order of between ten and thirty thousandths (0.010 to 0.030) and preferably approximately fifteen thousandths (0.015) of an inch in thickness, and is formed with a radial flange 50 at a lower end which engages an annular ring 52 of the upper end of housing 12. This annular ring 52 is engaged by spring 40 and biases against outer annular seal member 48 annular retaining ring 16 at the upper end of the cylindrical bore 36 of the housing 12. The thinness of the sleeve 42 enables the use of a nozzle and inner housing having an outer diameter almost equal to the bore of the outer housing. The sleeve need have a length only sufficient to extend between upper or outer pressure responsive seal 48 at the upper end of the housing 12 and lower or inner pressure responsive seal 52 part way along the inner housing in both extended and retracted positions.

The sleeve 42 and inner housing 20 are provided with retracting means in the form of coil compression spring 40, which biases the inner housing to the retracted position (FIG. 1) when water pressure is shut off. The sleeve is frictionally supported between outer ring 46 and annular inner ring 44 near the upper end of the inner housing, and frictionally engaging the inner surface of the sleeve 42. The spring 40 is positioned between the annular flange 38 and guide ring 46 at the upper end of the housing 12, which biases against outer annular seal assembly members 48 and 50 retained in position by the retaining ring 16.

The inner housing 20 serves as a riser and carries the rotating head 26 from its retracted position in the outer housing 12, as shown in FIG. 1, to an extended position above the ground surface where the head rotates and distributes water. The inner housing 20 converges at the top with inwardly tapering walls to an opening 52 in which is rotatably mounted a tubular shaft 54, having an upper end extending above the upper end of housing 20 on which the rotating head 26 is mounted. The shaft 52 serves to mount the head 26 convey water from the inlet to the nozzle and transfer torque from the drive train to the rotating head.

The driving assembly for rotating the head 26 is mounted in the inner housing 20 and includes support structure 56 having a journal 58 in which the lower end of the tubular shaft 54 is rotatably mounted. A shoulder 88 surrounds opening 52 and is engaged by a shoulder 90 on rotary shaft 54.

Figure 2:
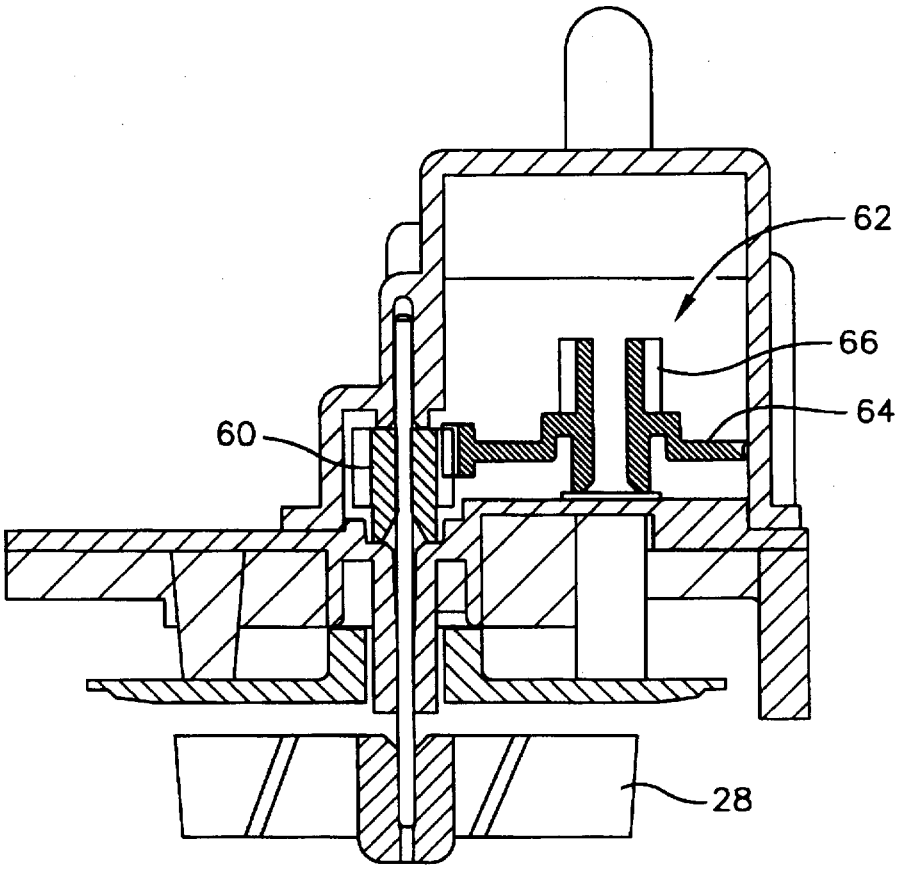
FIG. 2 is a detailed partial view a portion of the drive train of FIG. 1 showing the turbine and a first stage of drive reduction.
Figure 3:
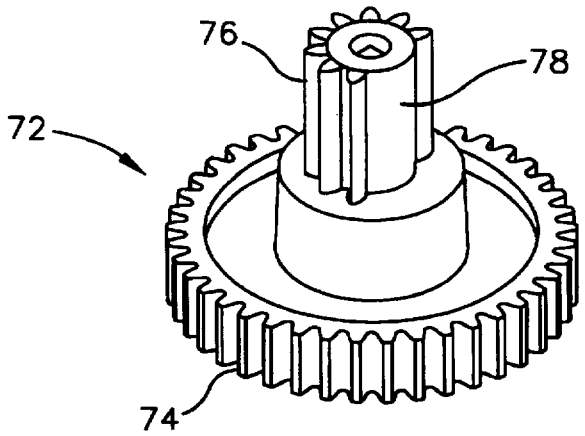
FIG. 3 is a detailed view a reduction drive unit illustrating the intermittent drive feature.

Referring to FIG. 2 the turbine wheel 28 rotates in response to water flowing through the sprinkler unit and is mounted on a shaft which drivingly rotates a pinion gear 60 which matches with and drives a reduction gear unit 62 having a larger driven gear 64 and a smaller pinion gear 66. The reduction gear unit 62 further drives a reduction gear 68 unit which in turn drives a reduction gear 70 unit further driving a reduction gear 72 unit. This reduction gear unit 72 is the final drive unit in the reduction drive assembly 30. This unit, as in previous embodiments, includes a larger driven gear 74 and a smaller driving pinion 76. The driving pinion gear 76 is provided with a gap 78 formed by the elimination or absence of gear teeth on the periphery thereof, which results in an interruption in its drive of the next gear in the gear train. In the illustrated embodiment three teeth of the pinion gear have been eliminated.

In the illustrated embodiment the pinion gear 76 forms the means for the interruption in the drive of the sprinkler head. This gear unit falls at the end of the drive train for the reduction drive train for the turbine wheel 28. The gear 76 meshes with a gear 80 on the shaft 82 for driving a pinion 84 which in turn drives an internal ring gear 86 which is connected to and driving the tubular shaft 54. This overall drive train provides an approximately 2000/1 reduction in rotation from the turbine wheel or turbine 28. In the illustrated embodiment three gear teeth have been removed or eliminated from the pinion gear 76 to provide a gap and an interruption in the drive. It is apparent that any number of teeth could be removed to provide the desired interruption or hesitation in the rotation of the head.

The gap in the gear teeth must appear in a driving gear to insure that the drive of the head will pick up and continue. The interruption could also be achieved by other devices, such as a drive clutch or coupling mechanism or a shifting mechanism such as in some of the reversing drives to provide an intermittent interruption in the drive of the head. However, the illustrated embodiment utilizing a gap in the gear teeth provides the simplest and least expensive structure for providing an interruption in the drive. The interruption should be provided such that the interruption occurs at a different position along the arc of rotation during each successive rotation. It should be constructed in a manner such that multiple interruptions will occur during each rotation or arc of rotation.

In operation, water enters through inlet 14 at the bottom of the housing opening check valve 92 and flowing upward through screen 94 into the inner housing 20. As the housing fills up and pressure in the housing 20 builds up, the inner housing begins to rise or extend from housing 12. When the nozzle clears the upper end of housing 12, water begins to flow through the housing and exit the nozzle. As water flows through the housing turbine 28 rotates and transmits its rotation through the gear drive to the head forcing it to rotate about the central axis of the housing. Each time gear 76 rotates top a position where the gap 78 engages gear 80 it moves out of driving engagement and rotation of the head momentarily stops until gear teeth on gear 78 again engage the teeth on gear 80. During this halt in rotation, the water issuing from nozzle 22 extends or reaches a short distance farther. It has been found to reach up to 20% farther during the halt in rotation.

While I have illustrated and described my invention by means of specific embodiments, it should be understood that numerous changes and modifications may be made therein without departing from the spirit and scope of the invention as defined in the appended claims:

I claim:

1. An intermittent drive sprinkler unit, comprising:

a housing having an inlet end and an outlet end, an inlet in said inlet end for connecting to a source of water, an outlet at said outlet end, and passage means connecting said inlet to said outlet;

a rotatable head mounted at said outlet end of said housing and including means defining said outlet for distributing a stream of water outward from said housing;

a drive assembly including a turbine and a reduction drive train connecting the turbine to the head for rotating said head;

means for intermittently interrupting said drive for causing said head to intermittently pause during rotation thereof.

2. A sprinkler system according to claim 1 wherein said means for interrupting said drive comprises an interruption in gear teeth on a gear in said gear train.

3. A sprinkler system according to claim 2 wherein said interruption is in a driving gear.

4. A sprinkler system according to claim 3 wherein said driving gear is at the end of said gear train.

5. A sprinkler system according to claim 1 wherein said means for interrupting said drive comprises a driven gear toward the end of said gear train having an interruption in gear teeth on said gear.

6. A sprinkler system according to claim 5 wherein said drive is interrupted at a different position of said sprinkler head during subsequent rotations.

7. A sprinkler system according to claim 1 wherein said means for intermittently interrupting said drive is timed to interrupt said drive at a different position of said sprinkler head during each subsequent rotations.

8. A sprinkler system according to claim 7 wherein said means for interrupting said drive comprises an interruption in gear teeth on a gear in said gear train.

9. A sprinkler system according to claim 8 wherein said interruption in gear teeth on a gear proximate the end of said gear train.

10. A sprinkler system according to claim 8 wherein said sprinkler unit is a pop-up unit and said rotating head is mounted in a retractable riser.

11. A sprinkler unit according to claim 10 wherein sprinkler unit is an adjustable arc oscillating unit.

12. An intermittent drive sprinkler unit, comprising:

a housing having an inlet end with means for connecting to a source of water, an outlet end, a rotatable head mounted at said outlet end for rotation about a vertical axis, an outlet including a nozzle in said head, and passage means connecting said inlet to said outlet;

a rotatable head mounted in an upper end of said housing for rotation about a generally vertical axis and having an outlet including a nozzle for distributing a stream of water outward from said housing;

a drive assembly including a turbine and a reduction drive train drivingly connecting said turbine to said rotatable head for rotating said head;

means for intermittently interrupting said drive for causing said head to intermittently pause multiple times during rotation thereof.

13. A sprinkler unit according to claim 12 wherein said means for interrupting said drive comprises an extended gap between a pair of adjacent gear teeth on a gear in said gear train.

14. A sprinkler system according to claim 13 wherein said interruption is in a driving gear.

15. A sprinkler system according to claim 14 wherein said driving gear is proximate the end of said gear train.

16. A sprinkler system according to claim 15 wherein said drive is interrupted at a different position of said sprinkler head during subsequent rotations.

17. A sprinkler system according to claim 12 wherein said means for intermittently interrupting said drive comprises a driven gear toward the end of said gear train having an gap between adjacent gear teeth on said gear.

18. A sprinkler system according to claim 17 wherein said means for intermittently interrupting said drive is timed to interrupt said drive at a different position of said sprinkler head during each subsequent rotations.

19. A sprinkler system according to claim 18 wherein said sprinkler unit is a pop-up unit and said rotating head is mounted in a retractable riser.

20. A sprinkler system according to claim 12 wherein said sprinkler unit is a pop-up unit and said rotating head is mounted in a retractable riser.

* * * * *